US007097493B1

(12) United States Patent
Roth

(10) Patent No.: US 7,097,493 B1
(45) Date of Patent: Aug. 29, 2006

(54) APPARATUS AND METHOD FOR INTERFACING CONNECTORS TO NETWORK COMPONENTS

(75) Inventor: Marc L. Roth, New Market, AL (US)

(73) Assignee: ADTRAN, Inc., Huntsville, AL (US)

( * ) Notice: Subject to any disclaimer, the term of this patent is extended or adjusted under 35 U.S.C. 154(b) by 0 days.

(21) Appl. No.: 11/035,837

(22) Filed: Jan. 14, 2005

(51) Int. Cl.
*H01R 11/20* (2006.01)

(52) U.S. Cl. ..... 439/418; 439/409; 439/341

(58) Field of Classification Search ..... 439/418, 439/409, 341
See application file for complete search history.

(56) References Cited

U.S. PATENT DOCUMENTS 5,147,218 A 9/1992 Matthews et al. ..... 439/404
6,682,363 B1 * 1/2004 Chang ..... 439/409

OTHER PUBLICATIONS

*3M 710 Splicing Rig* ,3M, Telecom Access Division, 3M Telecommunications, © 2003.
*3M 710 Splicing System* ,3M, Communications Market Division, 3M Telecommunications, © 2004.

* cited by examiner

*Primary Examiner*—Truc Nguyen
(74) *Attorney, Agent, or Firm*—Thomas, Kayden, Horstemeyer & Risley, L.L.P.

(57) ABSTRACT

The interface apparatus has a connector-receiving unit for receiving a connector that is electrically connected via a conductor to a first device. The connector has a receiving opening corresponding to the conductor. The apparatus further has a port for receiving a cable terminator electrically connected to a second device that is configured to communicate with the network component. Furthermore, the apparatus has a component electrically connected to the port that has a conductive probe movably positioned with respect to the receiving opening corresponding to the conductor of the connector. The component has an actuation component that moves the conductive probe into the receiving opening of the connector when actuated thereby establishing a conductive path between the first device and the second device.

21 Claims, 9 Drawing Sheets

APPARATUS AND METHOD FOR INTERFACING CONNECTORS TO NETWORK COMPONENTS

RELATED ART

A typical telecommunications network comprises a plurality of customer sites, and each site has customer premise equipment (CPE) for interfacing with a central office (CO). The CPE at each customer site is typically connected to the CO via one or more subscriber lines. Therefore, network components at the CO are configured to receive and terminate a plurality of subscriber lines that are routed to the CO from various customer sites.

The network components, such as a digital subscriber lines multiplexor (DSLAM) that receive and terminate subscriber lines usually multiplex signals received from the subscriber lines for transmission on fewer high-speed channels, such as, for example, asynchronous transfer mode (ATM) channels.

FIG. 1 depicts a portion of CO equipment in a conventional central office 100. In FIG. 1, subscriber lines 104 are received at the CO 100 and terminated via connectors 200. Typically, the subscriber lines 104 are directly terminated by connector 200, as shown in FIG. 1. Alternatively, however, the subscriber lines 104 can be terminated via a connector 110 that interfaces with connector 200. Notably, each subscriber line 104 typically comprises a pair of conductors, e.g., copper wires. Each connector 200 receives a plurality of subscriber lines 104 and each subscriber line is terminated via the connector 200.

Connector 110 may further interface test equipment 114 via the connector 200. In this regard, a plurality of conductors 116 are terminated via the connector 110. The connector 110 then electrically connects to the connector 200 thereby interfacing the test equipment 114 to the connector 200. Thus, the test equipment 114 is interfaced with the network component 120 via the connector 110 and the connector 200.

Therefore, the connector 200 typically interfaces with the subscriber lines 104, the connector 110, and the network component 120. The connector 200 connects to the network component 120, e.g., a digital subscriber line access multiplexer (DSLAM), via connections 203. The network component 120 multiplexes signals received from the connections 203 onto a high-speed line 118, e.g., an asynchronous transfer mode (ATM) channel.

An exemplary connector 200 for connecting the subscriber lines 104 and the connector 110 to the network component 120 is a 710 modular connector manufactured by 3M™. Such a connector is manufactured in a variety of sizes configured to receive 5, 10, or 25 subscriber lines.

While the connector 110 can be used to interface the subscriber lines to the connector 200, typically the connector 110 is used to terminate conductors emanating from test equipment 114, as shown. For testing, the connector 110 is typically manually joined by a technician (not shown) to the connector 200. The technician visually aligns corresponding male and female components on the connectors connector 200 and 110 and squeezing the connectors together to establish the connection. Such a connection method lends itself to error because the connector 110 oftentimes breaks during disconnection.

Such problems are also inherent when testing the network component 120 either prior to shipment for use at a CO or at the CO during operation. In this regard, it is oftentimes inefficient to connect the connectors 200 and 110 only temporarily. For example, the connector 110 may terminate lines attached to test equipment 114 that is used prior to shipment of the network component 120 to ensure that the network component 120 is working properly. In such a scenario, the connector 200 may be connected to the connector 110 temporarily so that the network component 120 can be tested, which opens up the opportunity for the connector 110 to be damaged when disconnecting the connector 110 from the connector 200.

Further, if during operation, the network component 120 requires testing, the connector 110 is connected to the connector 200, and such connection enables the test equipment 114 to communicate with the network component 120. After testing is completed, the connector 110 is disconnected from the connector 200, and it is possible for the connector 110 to become damaged requiring replacement.

Furthermore, oftentimes the connector 200 that terminates the lines 203 from the network component 120 are protected with potting compound. In this regard, potting compound is inserted into openings (not show) that provide conductive connections in the connector 200 prior to shipping the network component 120 in order to protect the openings from damage, for example, damage that may result from moisture. Connector 200 can also be damaged during testing prior to shipping, because connector 110 connects to the potted openings thereby eliminating the potting material. Once the connector 110 connects to the connector 200 and eliminates the potting material, the connections are then exposed and can become damaged.

Such methods of testing the network component 120 reduce assurances that connectivity across the lines 203 connecting to the network component 120 are effective. Furthermore, such methods increase the chance that the connector 110 will become damaged during testing when separated from the other connector 200 that is connected to the subscriber lines 104 or test equipment 114.

BRIEF DESCRIPTION OF THE DRAWINGS

FIG. 13 FIG. 12 is the plunger assembly of FIG. 11 when the plunger assembly is blocking the handle.

DETAILED DESCRIPTION

Generally, the present disclosure provides an apparatus and method for interfacing to a network component, such as a digital subscriber line multiplexer (DSLAM), capable of multiplexing data from a plurality of digital subscriber lines (DSLs) onto a single high-speed line. Specifically, an apparatus in accordance with the present disclosure receives a connector 200 (FIG. 1), e.g., a 710 connector, to establish a workable connection between test equipment 114 (FIG. 1) and the network component 120 (FIG. 1) via a test port.

The apparatus of the present disclosure mechanically and systematically establishes connections between the various connections of the port interfacing with the test equipment and the plurality of wires connected to the network component. For exemplary purposes, the present disclosure is described in the context of testing a DSLAM having a plurality of 710 splice connectors for interfacing the DSLAM to a plurality of subscriber lines. However, other types of network components and other types of connectors are possible in other embodiments of the present disclosure.

Figure 2:
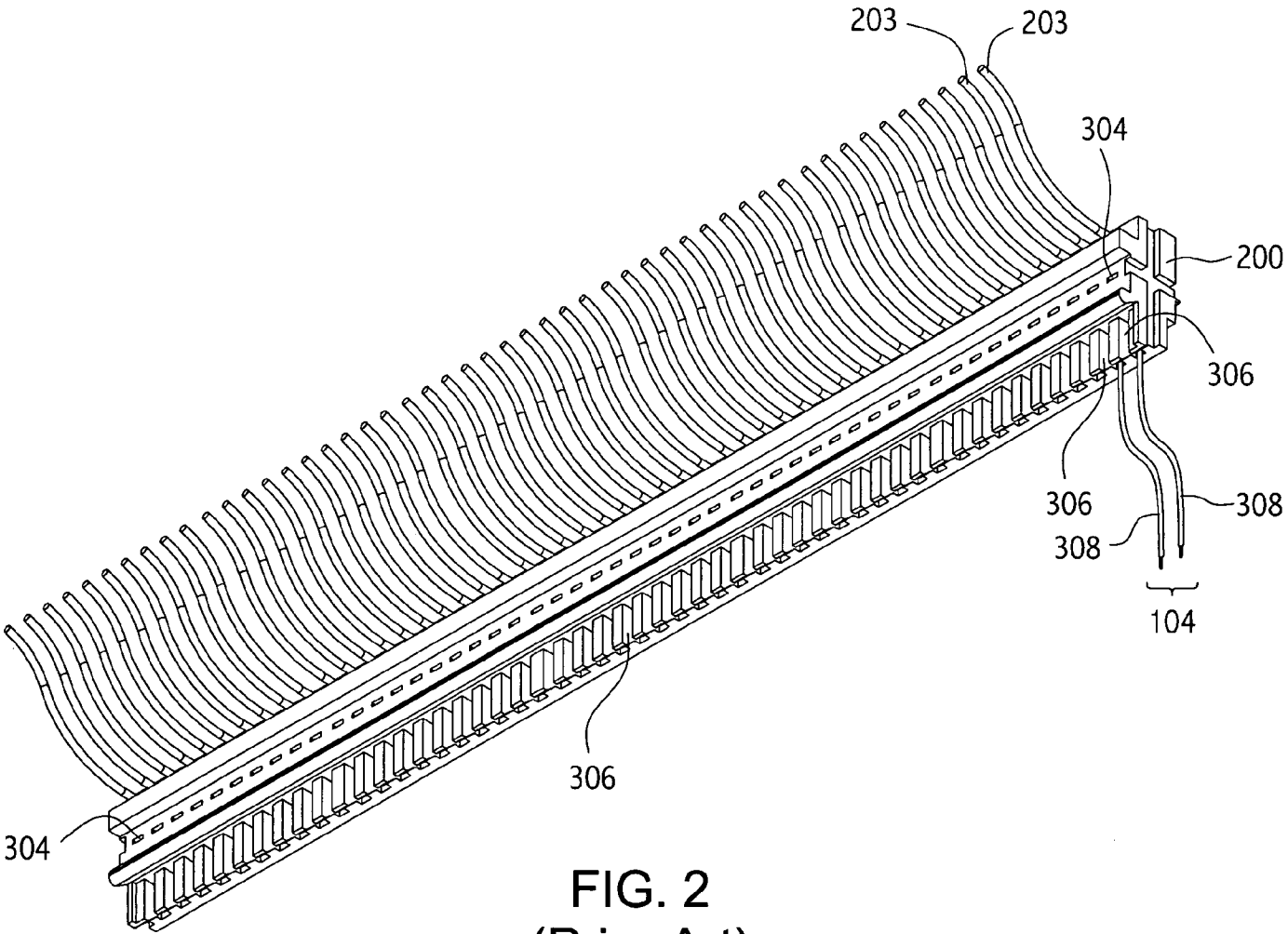
FIG. 2 (Prior Art)
FIG. 2 is a perspective view of a conventional 710 modular connector for splicing 25 subscriber line pairs.

FIG. 2 depicts a 710 modular connector 200 for use in connection with an exemplary interface apparatus of the present disclosure described in more detail hereafter with reference to FIGS. 2–5.

The connector 200 depicted in FIG. 2 splices 26 to 22 American Wire Gauge (AWG) conductors, although other gauges are possible in other embodiments. Such a connector 200 can be in various configurations for receiving various numbers of conductors. However, the illustrated connector 200 is capable of receiving up to twenty-five subscriber lines 104, each of which comprises a pair of subscriber line conductors 308. The connector 200 receives each subscriber line conductor 308 comprising a subscriber line 104 via subscriber line openings 306 and establishes a connection between the conductors 308 and the conductors 203.

As noted herein, an embodiment of the present disclosure is described with reference to receiving subscriber lines 104 comprising a pair of subscriber line conductors 308. However, in other embodiments, the connector 200 may receive any type of conductor 308, and establish a connection between such received subscriber line conductor 308 and conductor 203. Conductors 308 of the subscriber line 104 are described for exemplary purposes. The established connection between the conductors 308 and the conductors 203 is described in more detail with reference to a cross-sectional view of the connector 200 depicted in FIG. 4.

Furthermore, the conductors 308 may be retained by a bridge (not shown) when each of the conductors 308 have been inserted into the subscriber line openings 306. In this regard, once the conductors 308, in accordance with the particular relevant application, have been inserted into the subscriber line openings 306, a presser tool (not shown) may be used to splice the wires to the connector 200 and the bridge may then be attached across each of the conductors 308 and subscriber line openings 306 to ensure retention of the conductors 308 by the connector 200.

Figure 1:
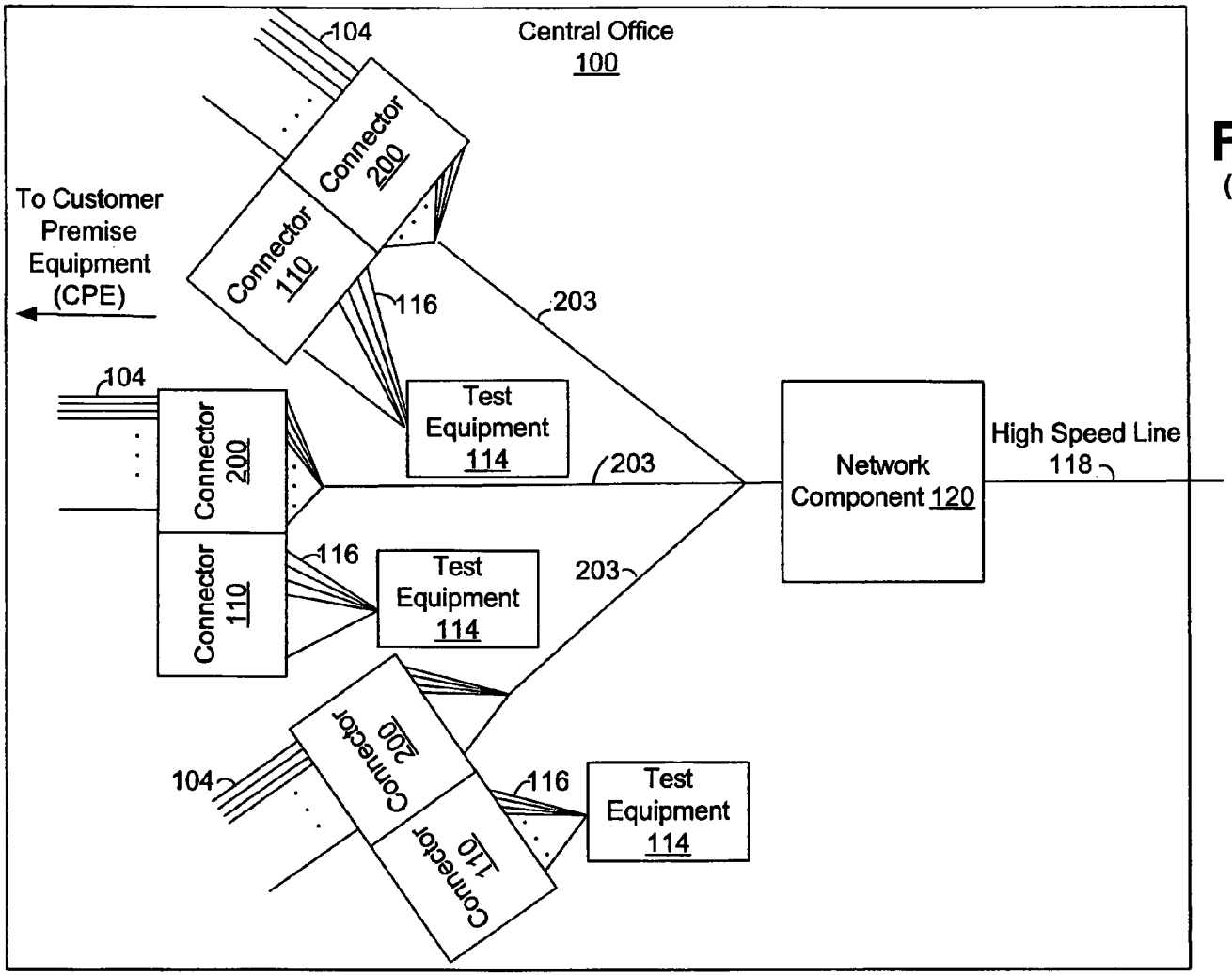
FIG. 1 (Prior Art)
FIG. 1 is a block diagram illustrating a conventional central office.

Additionally, the connector 200 comprises test openings 304. The test openings 304 also provide access for establishing connection to the conductors 203. In this regard, the connector 200 may receive prongs (not shown) of another connector 110 (FIG. 1) that is connected to conductors 116 (FIG. 1). When the connector 110 is inserted into the test openings 304, such insertion establishes a connection between the test conductors 116 and the conductors 203. While it is possible for the conductors 308 to be connected to a connector 110 during normal operation and thereby connected to the conductors 203, the connector 110 is typically connected to test equipment 114 (FIG. 1) via the plurality of conductors 116. Thus for testing purposes, the connector 110 can be inserted into the test openings 304 and interface to the network component 120 via the connector 200 without interfering with the subscriber line conductors 308 inserted into subscriber line openings 306.

Figure 3:
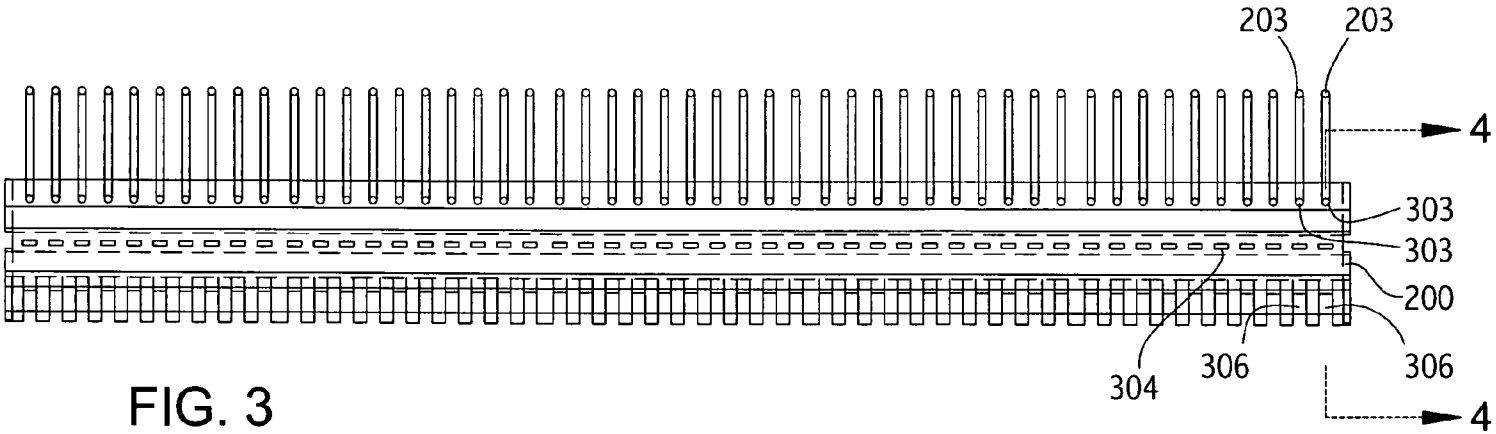
FIG. 3 (Prior Art)
FIG. 3 is a top view of the connector of FIG. 2.

FIG. 3 depicts a top plan view of the connector 200. The connector 200 comprises three connection interfaces. First, the top plan view in FIG. 3 depicts network component openings 303 for receiving the conductors 203 (FIG. 1). Such conductors originate at the network component 120. Second, the connector 200 receives the connector 110 (FIG. 1) via the test openings 304, which establishes a connection between the conductors 203 and the conductors 116 (FIG. 1), which interface the test equipment 114. Third, the connector 200 receives conductors 308 (FIG. 3) via subscriber line openings 306, which may comprises subscriber lines 104 (FIG. 1) or some other type of conductor. Via the connector 200, electrical contact is possible between the test equipment 114 (FIG. 1) and the conductors 203, the network component 120 (FIG. 1) and the conductors 203, and a plurality of subscriber lines 104 (FIG. 1) and conductors 203.

Figure 4:
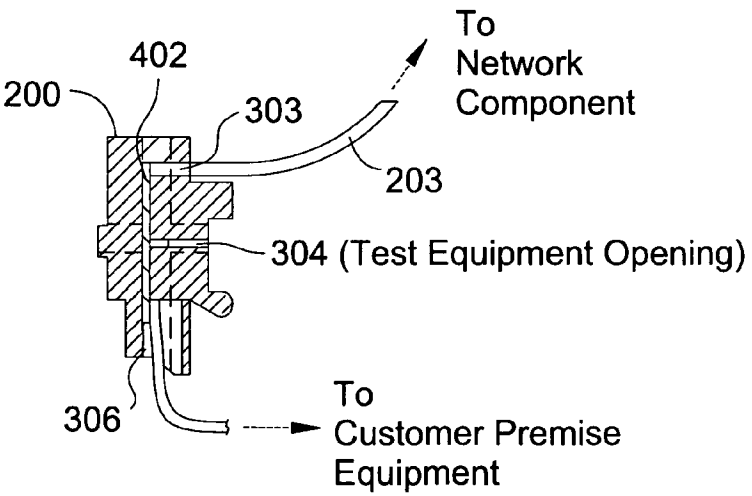
FIG. 4 (Prior Art)
FIG. 4 is a cross sectional view of the 710 modular connector depicted in FIG. 3.

FIG. 4 illustrates the electrical connection established between the conductors 203 (FIG. 2) and the conductors 116 (FIG. 1) from the test equipment 114 (FIG. 1) and the conductors 308 from the subscriber lines 104. The connector 200 receives the wire 203 via the network component opening 303 as described above. When the wire 203 is inserted into the network component opening 303, contact is made between a metal contact 402 and the wire 203. Such connection may be established via crimping, a technique known in the art.

Likewise, when the connector 110, e.g., a male connector, is inserted into the test opening 304, contact is made between the metal contact 402 and any conductor 116 that may be retained by the connector 110. Thus, a conductive path is established from the test equipment 114 to the conductor 203 by the contact 402 via the conductor 116.

Additionally, a conductor 308 (FIG. 2) is inserted into the subscriber line opening 306 making contact with the metal contact 402. Thus, an electrical connection is established between the conductor 308 and the conductor 203 via the contact 402. Also, the conductive path may be effectuated by crimping the conductor 308 and the connector 200 and/or retained by a bridge (not shown) as described hereinabove.

Figure 5:
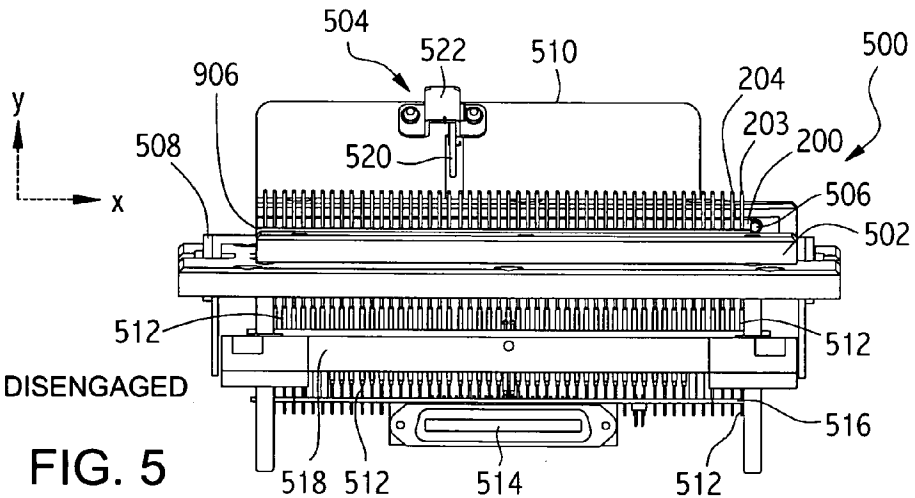
FIG. 5 is a front plan view of a device interface apparatus in accordance with an exemplary embodiment of the present disclosure.

FIG. 5 is a front view of an interface apparatus 500 in accordance with an exemplary embodiment of the present disclosure. Notably, the front view shown in FIG. 5 is shown disengaged. In this regard, "disengaged" refers to a state in which the interface apparatus 500 is not mechanically positioned to allow contact between a connector 200 (FIG. 2) that may be inserted into the apparatus 500 and any test equipment that may be connected to the apparatus 500. The assembly's engaged and/or disengaged status will be described in more detail hereinafter.

The interface apparatus 500 generally comprises a connector-receiving unit 502, a handle-retaining device 504, a handle 508, a plurality of contact probes 512, a printed circuit board (PCB) 516, and an interface port 514.

The connector-receiving unit 502 receives the connector 200 depicted by FIGS. 2–4 in a slot 906, which is described in more detail with reference to FIG. 9. In this regard, a user of the interface apparatus 500 inserts the connector 200 into the receiving unit 502 by sliding it into the slot 906 of the receiving unit 502. Such insertion is described in more detail with reference to FIG. 6.

When the connector 200 is completely seated in the receiving unit 502, the connector 200 is positioned such that each of the subscriber line openings 306 is accessible to receive probes 512 when interface apparatus is engaged. In one embodiment, each probe 512 is spaced 0.138 inches apart from the center of the probe to the center of its adjacent probe. In another embodiment, the probes are clustered into five clusters often probes, and each cluster is 0.158 inches apart and each probe within each cluster is 0.138 inches apart center to center. In this regard, note that subscriber line openings 306 (FIG. 3), which are not visible in FIG. 5, are positioned such that each is aligned with a contact probe 512 described in more detail hereafter.

Furthermore, as described herein, the test openings 304 are shipped with a potting compound that protects such openings from damage from, for example, water. Because the probes are inserted into the subscriber line openings 306, as opposed to inserting a connector 110 into the test openings 304, the potting that is placed within the test openings 304 is left undisturbed. Thus, the network component 120 to which the connector is connected can be tested by the test equipment 114 (FIG. 1) prior to shipment of the network component 120 without eliminating the protection provided by the potting within the test openings 304 because subscriber line openings 306 are used to test the network component 120.

In one embodiment, the receiving unit 502 further comprises a stop 506. Such stop 506 is spring loaded and, when relaxed, protrudes into the insertion path of the slot 906 in which the connector 200 inserted. Thus, once a connector 200 is inserted into the slot 906 and is fully seated therein, the stop 506 disallows any movement by the connector 200 in the positive x-direction after it has been inserted. Furthermore, the connector 200 is prevented from moving in the negative x-direction by the receiving unit 502, because the slot 906 recesses within the receiving unit 502. Such is illustrated in more detail with reference to FIGS. 9 and 10.

Figure 11:
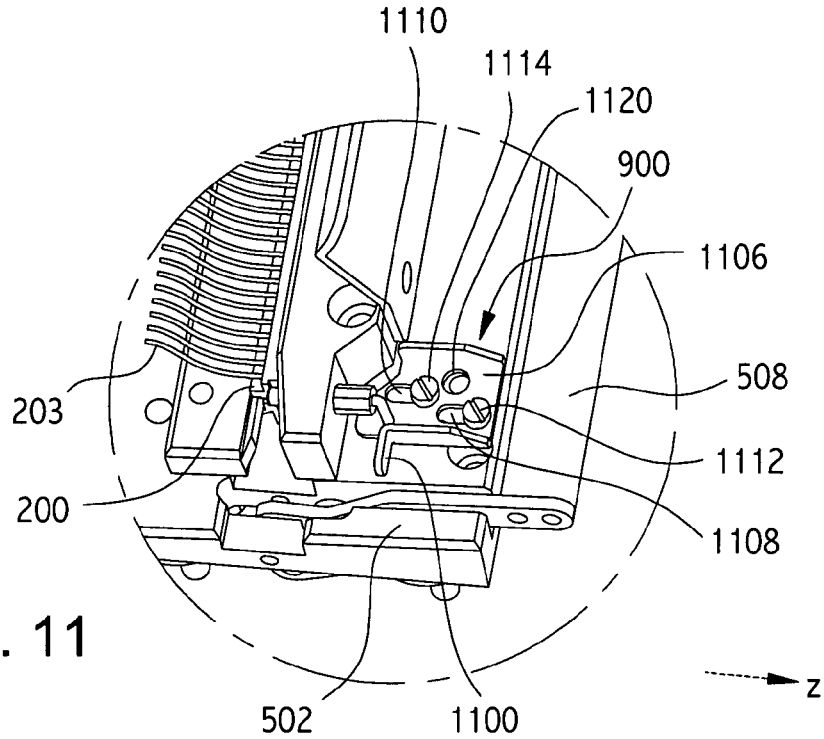
FIG. 11 is a plunger assembly of the device interface apparatus depicted in FIG. 8 in accordance with an exemplary embodiment of the present disclosure when the interface apparatus is disengaged.
Figure 12:
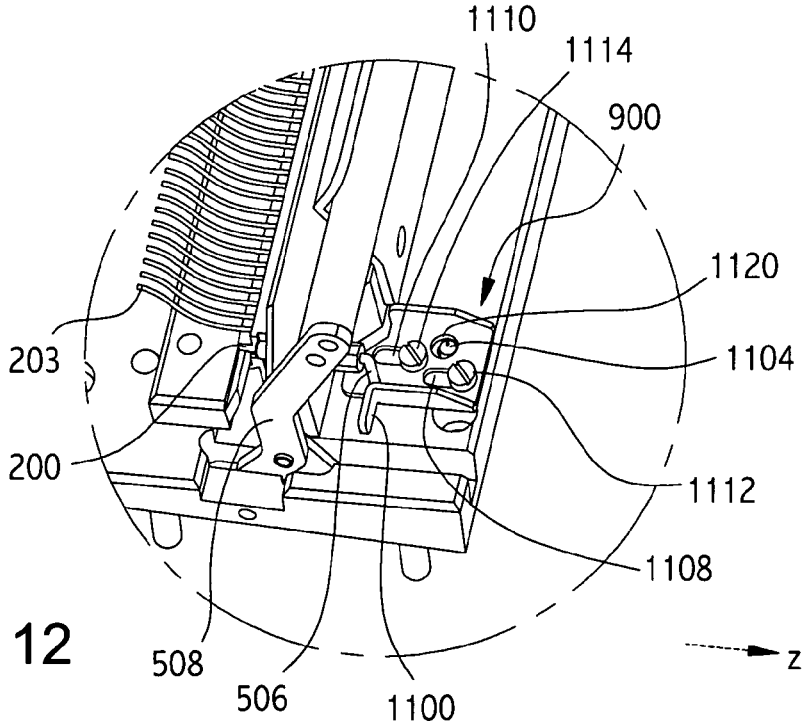
FIG. 12 is the plunger assembly of FIG. 11 when the interface apparatus is engaged.

The stop 506 is described in more detail with reference to FIGS. 9–12. Note that the stop 506 extends through the receiving unit 502 and is affixed to a slidable base 1106 (FIG. 11), which is depicted in FIGS. 11 and 12 and is described further hereinafter.

The handle-retaining device 504 is rigidly affixed to a plate 510, which extends from the receiving unit 502. The handle-retaining device 504 comprises a movable hook 520, that engages and retains the handle 508 when the apparatus 500 is engaged. In this regard, "engaged" refers to a state in which the interface apparatus 500 is mechanically positioned to allow contact between the connector 200 inserted into the apparatus 500 and any test equipment 114 (FIG. 1) that may be connected to the port 514. The assembly's engaged and/or disengaged status is described in more detail hereinafter. In one embodiment, the hook 520 is spring-loaded, and retention of the handle 508 by the hook 520 will be described in more detail with reference to FIGS. 7 and 8.

The probe elevator 518 is linearly connected to the receiving unit 502. Complementarily, the probe elevator 518 is pivotally connected to the handle 508. Thus, that when the handle 508 is engaged in the positive y-direction, the probe elevator 518 moves in a positive y-direction with respect to the apparatus 500.

In particular, when the handle 508 is moved toward the plate 510 of the apparatus 500, the probe elevator 518 moves in the positive y-direction. When the handle 508 is moved away from the plate 510, the probe elevator 518 moves in the negative y-direction. Such is described in more detail with reference to FIGS. 7 and 8.

The probe elevator 518 rigidly retains the plurality of contact probes 512. In this regard, the contact probes 512 are affixed to the probe elevator 518 and extend perpendicular to and through the probe elevator 518. The probes 512 are further attached to the PCB 516, which as described is rigidly affixed parallel to the probe elevator 518.

Therefore, when the handle 508 is actuated and the probe elevator 518 moves in a positive y-direction toward the receiving unit 502, as described hereinabove, the plurality of probes 512 and the PCB to which the probes 512 are attached also moves in a positive y-direction toward the receiving unit 502. When the handle 508 is actuated, it is lifted in the positive y-direction and rotated about the x-axis such that it is displaced also in the negative z-direction such that it is coupled to the handle-retaining device 504.

Therefore, the probes 512 extend up through the receiving unit via openings (not shown) in the receiving unit 502, and the probes 512 insert into the subscriber line openings 306 and contact the metal contact 402 (FIG. 4) of the connector 200 that is inserted in the receiving unit 502.

Figure 6:
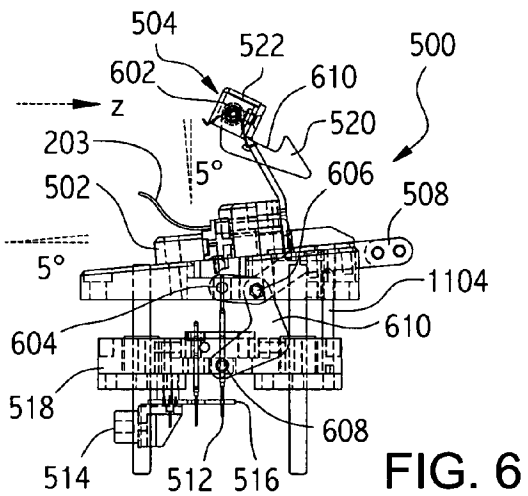
FIG. 6 is a side view of the device interface apparatus depicted in FIG. 5.

FIG. 6 depicts a side view in the z-direction of the disengaged apparatus 500 of FIG. 5. As described above, the receiving unit 502 receives the connector 200. The wires 203 (FIG. 5) extend from the connector 200 to a network component 120 (FIG. 1). Notably, the handle 508 is not secured by the hook 520 and the probes 512 are not interfaced with or connected to the connector 200.

As described with reference to FIG. 5, the handle-retaining device 504 comprises the retaining hook 520 and the housing 522. The hook 520 is spring-loaded and connected to the housing 522 so that the hook 520 can be actuated in a negative y-direction, receive the handle 508 within the recess 610, and retain the handle 508 by actuating back in a positive y-direction to a resting position as shown in FIG. 6. Retention of the handle by the hook 508 is shown and described with reference to FIGS. 7 and 8.

As described herein with reference to FIG. 6, the handle 508 is pivotally connected to the receiving unit 502 via pivotal connection 604 to allow actuation of the handle 508. With further reference to FIG. 6, the handle 508 is pivotally connected to a first end of a linkage 610 via a pivotal connection 606, and the linkage 610 is pivotally connected to the probe elevator 518 at a second end via a pivotal connection 608.

Thus, when the handle 508 is lifted in a positive y-direction with respect to the apparatus 500, the linkage 610 moves about connection 608 causing the elevator 518 to move in a positive y-direction toward the receiving unit 502. Further, as the handle 508 moves in the positive y-direction, the linkage 610 moves about connections 604 and 606 thereby lifting the elevator 518 toward the receiving unit 502 and allowing the handle 508 to move toward the handle-retaining device 504. The handle 508 is lifted in the positive y-direction and rotates about the x-axis such that the handle 508 is displaced in the negative z-direction until it is coupled to the handle-retaining device 504. Retention of the handle 508 by the handle-retaining device 504 is described further in detail with reference to FIGS. 7 and 8.

The probe elevator 518 further comprises a rod 1104 that is rigidly affixed perpendicular to the probe elevator 518. Such rod 1104 extends through the receiving unit 502 and works in conjunction with a plunger assembly 900 (FIG. 9) which is described in more detail hereafter. Thus, when movement of the handle 508 causes the probe elevator 518 to move in the positive y-direction, the rod 1104 consequently moves in the positive y-direction extending further through the receiving unit 502 and projecting out from the receiving unit 502. Projection of the rod 1104 ultimately prohibits the connector 200 from being removed from the slot 906 (FIG. 5) until the handle 508 is released from the handle-retaining device 504. Such is described in more detail with reference to FIG. 11.

In one embodiment of the apparatus 500, the shape of the receiving unit 502 is tapered as illustrated in FIG. 6. In this regard, the receiving unit 502 tapers at a five-degree angle as indicated. Such tapering of the receiving unit 502 creates a slight tilt in the receiving unit 502 as indicated as a five-degree angle such that when the connector 200 is inserted into the slot 906, the subscriber line openings 306 are positioned at a five-degree angle with respect to the probes 512 that are to be inserted into the subscriber line openings 306 when the probe elevator 518 is moved to engage the receiving unit 502.

Figure 7:
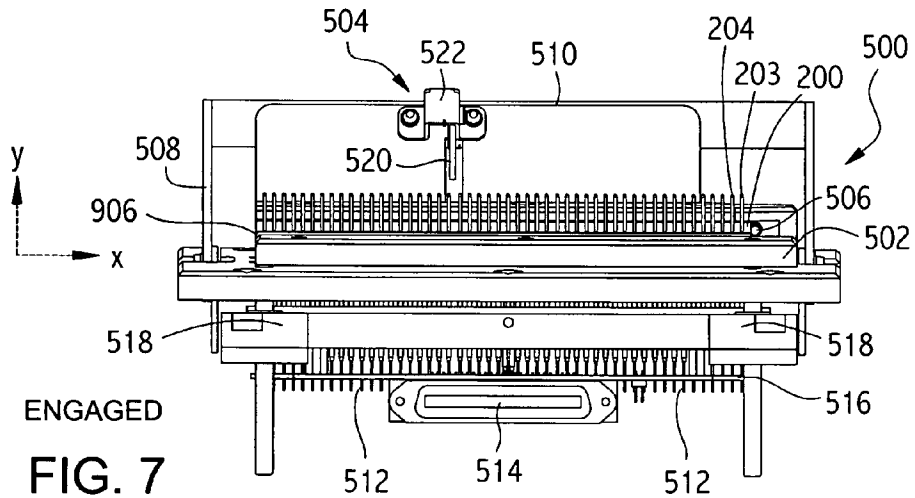
FIG. 7 is a front plan view of the network component interface apparatus depicted in FIG. 5 in an engaged position.

FIG. 7 depicts the interface apparatus 500 engaged. In the engaged position, the handle-retaining device 504 retains the handle 508 in an elevated position such that probes 512 secured to the probe elevator 518 are electrically engaged with the connector 200. As described hereinabove, as the handle 508 is actuated to the engaged position and retained by the handle-retaining device 504, the PCB 516 and the probe elevator 518 move toward the connector-receiving unit 502, and when the handle 508 is ultimately affixed to the handle-retaining device 504, the probes 512 are inserted into the subscriber line openings 306. Thus, electrical contact is established between the wires 203 and the corresponding probes 512 aligned with the subscriber line openings 306 corresponding to the wires 203. As described hereinabove, the probes 512 are inserted at an angle of five degrees due to the tapering of the receiving unit 502.

Furthermore, each of the probes 512 is preferably soldered to or is otherwise electrically connected with electrical contacts (not shown) on the PCB 516. The PCB further comprises electrical routings from each of the probes 512 to corresponding connections (not shown) associated with the port 514.

Therefore, when a cable connector (not shown) is inserted into the port, test equipment 114 (FIG. 1) terminated by the cable connector can access a network component, e.g., a DSLAM, that is connected to the 710 modular connector 200 inserted into the interface apparatus 500.

In one embodiment, the port 514 is a port and the test equipment comprises a cable that is terminated via a connector, e.g., a "champ" connector. However, other types of ports and other types of connectors are possible in other embodiments of the present disclosure.

Figure 8:
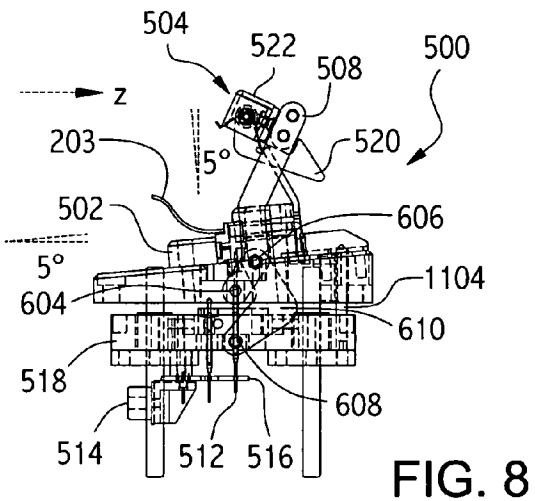
FIG. 8 is a side view of the network component interface apparatus depicted in FIG. 8.

FIG. 8 illustrates a side view of the interface apparatus 500 of FIG. 7 when the interface apparatus 500 is engaged, as described hereinabove.

In the engaged position, the handle 508 is lifted and placed within the recession 610 of the hook 520. The spring loaded action of the hook 520 retains the handle 508 in the lifted position.

Additionally, when the apparatus 500 is in the engaged position as illustrated in FIG. 8, the probe elevator 518 and the PCB 516 to which the probe elevator 518 is affixed is lifted in a positive y-direction toward the receiving unit 502. In the final retained position, the probe elevator 518 is situated such that the probes 512 attached to the probe elevator 518 engage the connector 200 via the subscriber line openings 306 (FIG. 3). Thus, a cable terminator (not shown) that may be inserted into the port 514 can receive and transmit electrical signals through, the port 514, the PCB 516, the probes 512, and ultimately to the wires 203 and 204 of the connector 200. For example, if test equipment 114 (FIG. 1) is connected to the cable terminator and the wires 203 and 204 are connected to a DSLAM as described herein, the apparatus 500 interfaces the test equipment to the DSLAM so that the DSLAM can be tested or otherwise operated via the test equipment 114 (FIG. 1).

Figure 9:
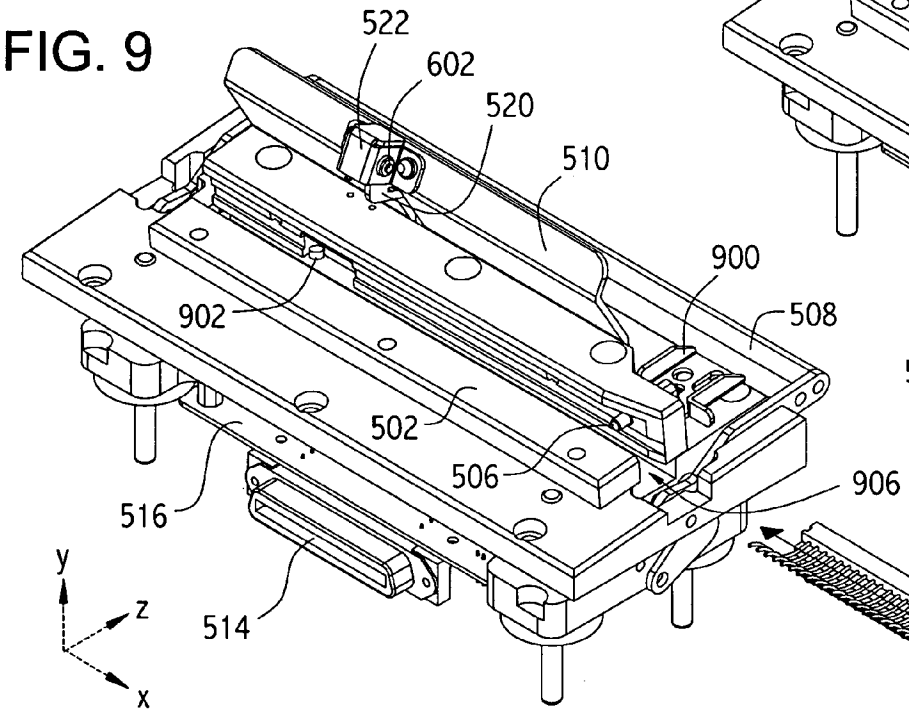
FIG. 9 is a perspective view of the device interface apparatus of FIG. 8 illustrating insertion of the connector of FIG. 2 into the interface assembly.

FIG. 9 depicts a perspective view of the apparatus 500 of the present disclosure. FIG. 9 illustrates the apparatus 500 and the connector 200 positioned prior to insertion of the connector 200 into the receiving unit 502.

The receiving unit 502 preferably comprises the slot 906 that is formed to receive the connector 200. In addition, the receiving unit 502 comprises a plunger assembly 900 that is affixed to the stop 506 described hereinabove and a limit switch 902.

Note that the slot 906 of the receiving unit 502 is shaped in accordance with the connector 200. In this regard, the connector 200 is made of a deformable material such that connector 200 have a propensity to bend or bow. However, because the shape of the receiving unit 502 conforms to the normal shape of the connector 200, when the connector 200 is inserted into the slot 906, and bend or bow in the connector 200 from connector use 200 is remedied by the slot 906.

Furthermore, as noted herein, the connector 200 can be implemented in a variety of sizes. In this regard, as the number of necessary conductors 308 needed for an application decreases, so does the length of the connector 200. However, the slot 906 is sized so that it can accept the longest size of the connector 200, one that receives twenty-five subscriber lines 104, i.e., fifty conductors 308. However, a conductor that receives only five subscriber lines 104, i.e., ten conductors 308, is much shorter in length that the twenty-five subscriber line connector 200. Therefore, the slot 906 can also be to receive such shorter connectors 200. Prior to inserting the shorter connector 200, a dummy connector (not shown) can be inserted into to the slot 906 that accounts for the reduced length of the shorter connector 200. The dummy connector can then be followed by the shorter connector 200, and the shorter connector 200 can serve to interface test equipment 114 (FIG. 1) to a network component 120 (FIG. 1) that has a cable terminated with the shorter connector. As noted herein, the 710 modular connector is manufactured in five, ten, twenty, or twenty-five subscriber line connectors.

Generally, the plunger assembly 900 ensures that the connector 200 is completely seated within the slot 906. In this regard, if the connector 200 is not completely seated within the slot 906, a user will be unable to move the handle 508 in a positive y-direction in order to engage the probes 512 and the connector 200. In this regard, if the connector 200 is not completely seated within the slot 906 alignment of the probes 512 (FIGS. 5–8) will not be ensured with the connector subscriber line openings 306 of the connector 200. Thus, when a user (not shown) attempts to engage the apparatus 500, the probes 512 may not engage the connector 200 establishing a connection to the wires 203 and 204. Therefore, the plunger assembly 900 does not allow engagement until the connector 200 is completely seated within the slot 906. The plunger assembly 900 is described in more detail with reference to FIGS. 11 and 12.

Furthermore, the limit switch 902 generally provides a safeguard to ensure that power is not present at the probes 512 until a connector 200 is inserted into the slot 906. Ensuring such reduces or eliminates the risk of accidental electrical shock of a user prior to a connector 200 being inserted into the slot 906. The limit switch is described in more detail with reference to FIGS. 13 and 14.

Prior to insertion of a connector 200 into the slot 906, a user (not shown) actuates the plunger assembly 900. Such actuation is described in more detail with reference to FIGS. 11 and 12.

When the plunger assembly 900 is actuated, the stop 506 recedes from the path of the slot 906 thereby allowing the connector 200 to be inserted into the slot 906. The user may continue to actuate the assembly 900 until the connector 200 is completely seated within the slot 906. In this regard, when the user quits applying force to the assembly 900, the stop 506 protrudes back out into the path of the slot 506 if the connector 200 is completely seated.

However, the user may elect to let go of the assembly 900 prior to the connector 200 being fully seated within the slot 906. In such a case, the stop 506 is spring-loaded and positioned such that when the user lets go of the assembly 900 the stop 506 contacts the connector 200 until the connector 200 is fully seated as it is being slid into the slot 906. When it is fully seated within the slot 906 and is completely inserted and positioned correctly with respect to the probes 512 on the probe elevator 518, the stop 506 protrudes out into the path of the slot 906 via its spring-loaded characteristic.

Figure 10:
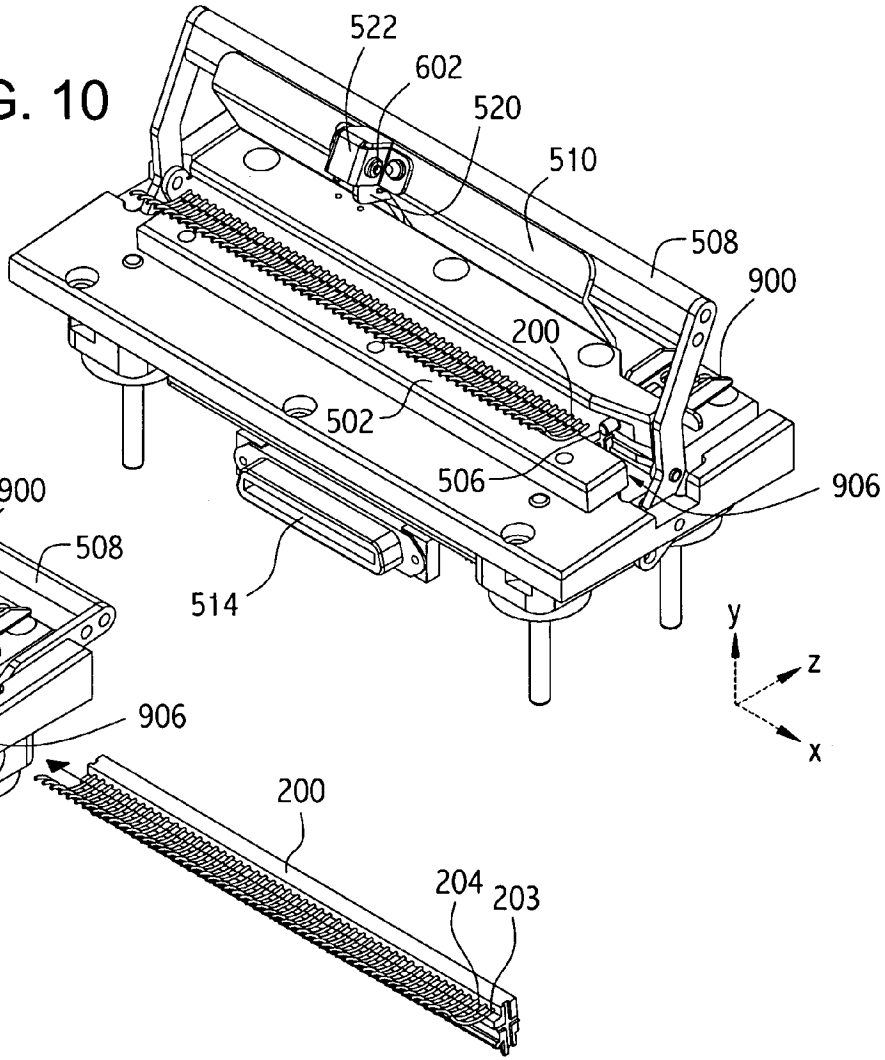
FIG. 10 is a perspective view of the device interface apparatus of FIG. 8 illustrating retention of the connector by the interface device.

Thus, as is illustrated in FIG. 10, as soon as the connector 200 is completely seated in the slot 906, the stop 506 pops out and blocks the connector 200 from movement in the positive x-direction.

The plunger assembly 900 is hereafter described in more detail with reference to FIGS. 11 and 12. With reference to FIG. 11, the plunger assembly 900 comprises a tab 1100 integral with a slidable base 1106. The slidable base 1106 comprises slide openings 1108 and 1110 and a stop opening 1120. Furthermore, the base 1106 is rigidly affixed to the stop 506 that extends through the receiving unit 502 and protrudes into the slot 906 as described with reference to FIGS. 9 and 10.

The plunger assembly 900 further comprises guide heads 1114 and 1112 that are attached to the receiving unit 502 and extend through the openings 1110 and 1108. The guide heads 1114 and 1112 guide the plunger assembly as it is being actuated by a user described further herein.

Further, the plunger assembly 900 comprises an opening 1120 through which the movable rod 1104 protrudes when the handle 508 is in the engaged position as described hereinabove. When the handle 508 is in the disengaged position, the rod 1104 recedes within the opening 1120 such that it is flush with the slidable base 1106 when the handle 508 is in the disengaged position as described hereinabove. Thus, the movable rod 1104 ensures that the slidable base 1106 can not be moved while the probes 512 are engaged with the connector 200. In this regard, if the rod 1104 is protruding through the opening 1120, then the slidable base 1106 cannot be moved by actuation of the tab 1100.

When a user of the apparatus 500 desires to insert a connector 200 into the slot 906 of the receiving unit 502, the user pushes on the tab 1100 in a negative z-direction away from the stop 506. When the user pushes the tab 1100, the base 1106 moves in the direction that the tab is being pushed. The guides 1112 and 1114 slide in the openings 1108 and 1110 thereby guiding the base 1106 in the direction of the pushed tab 1100. As will be described further herein, when the connector 200 is being inserted into the slot 906 (FIG. 9), the handle 508 is in the disengaged position as described hereinabove. The rod 1104 is mechanically coupled to the probe elevator 518 which is mechanically coupled to the handle 508 such that when the handle 508 is in the disengaged position, the stop 1104 is recessed within the opening 1120 and sits flush with the base 1106, as described hereinabove. Therefore, the rod 1104 does not prohibit or otherwise interfere with movement of the base 1106.

As described hereinabove, the base 1106 is rigidly connected to the stop 506. Therefore, when the user pushes on the tab 1100 and moves the base 1106, the stop 506 is moved out of the path of the slot 906 so that the connector 200 can be inserted into the slot 906. Once the connector 200 is completely within the slot 906 such that the stop 506 springs back into the path of the connector 200, the stop 506 prohibits movement of the connector 200 in a horizontal direction, as described hereinabove.

After insertion of the connector 200, the user lifts the handle 508, as indicated in FIG. 12. When the handle 508 is lifted, the probe elevator 518 moves the rod 1104 such that it now protrudes through the opening 1120. Therefore, if the user attempts to move the tab 1100, the rod 1104 prohibits the slidable base 1106 from moving. Thus, the stop 506 remains in the path of the slot 906 as long as the handle 508 remains in the engaged position. Therefore, while the handle 508 is in the engaged position, as described herein, the connector 200 in unable to move in the slot 906.

Figure 13:
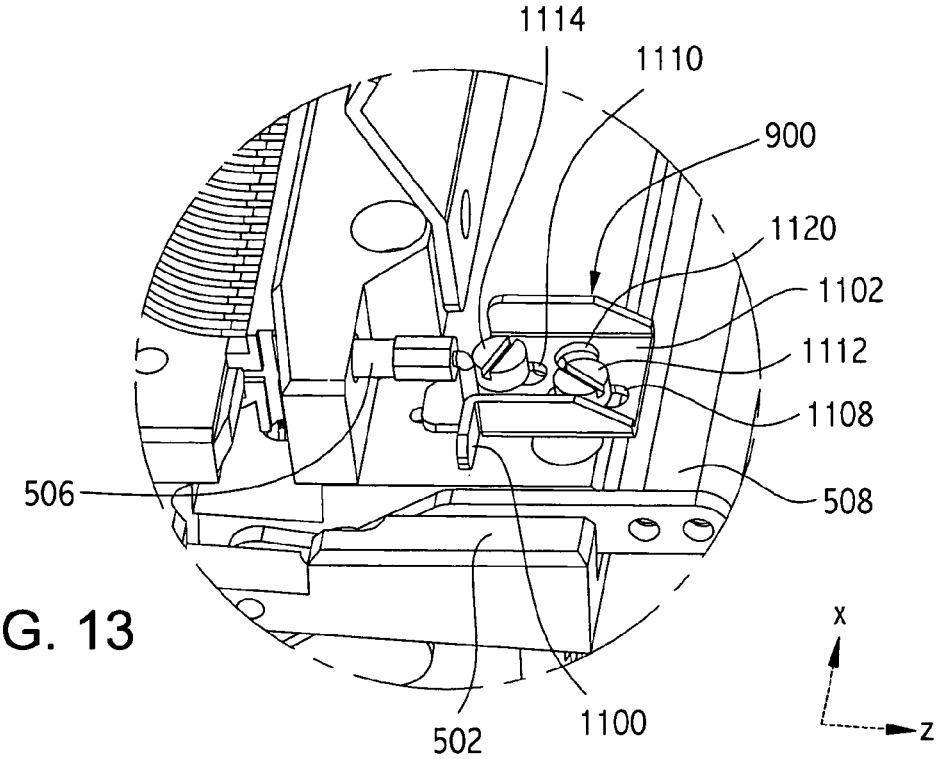

FIG. 13 illustrates another aspect of the plunger assembly 900 of the present disclosure. In this regard, when a user actuates the tab 1100, the plunger assembly 900 juts out and away from the receiving unit 502 as shown in FIG. 13, such that a portion of the plunger assembly 900 is in the line of movement of the handle 508 when the handle 508 is in a disengaged and resting position, as shown in FIG. 11. When the plunger 900 assembly is actuated by a user via the tab 1100 or when the user has released the tab 1100 but a connector 200 is still being inserted into the slot 906, the slidable base 1106 of the plunger assembly 900 continues to remain within the line of movement of the handle 508. Therefore, until the user releases the tab 1110 or until the connector 200 is completely seated within the slot 906, the handle 508 cannot be moved in order to engage the apparatus 500. Therefore, the plunger assembly further ensures that the probes 512 are not moved erroneously into subscriber line openings 306 of the connector 200 prior to the connector being fully within the slot 906.

Figure 14:
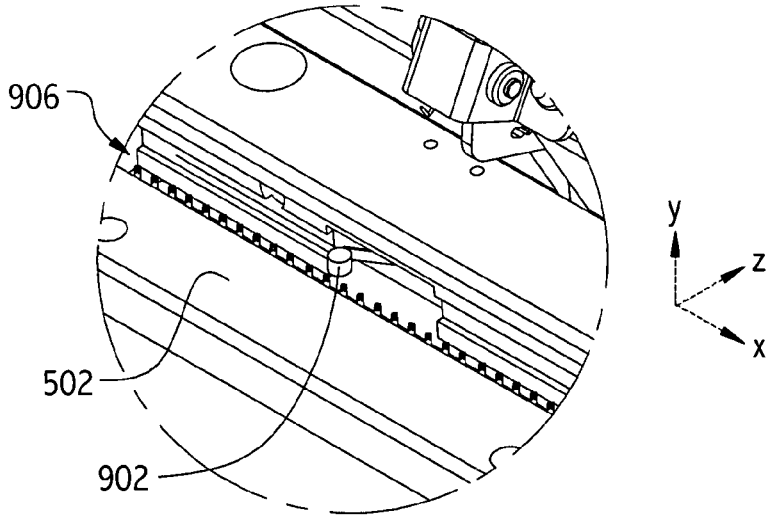
FIG. 14 is an exemplary limit switch of the interface apparatus depicted in FIG. 8 in accordance with an exemplary embodiment of the present disclosure.

FIG. 14 depicts the limit switch 902 described hereinabove. The limit switch 902 ensures that power is not provided to the probes 512 until a connector 200 is inserted into the slot 906. In this regard, when a connector 200 is not present in the slot 906, the switch 902 slightly protrudes into the slot 906. However, when a connector 200 is inserted into the slot 906, the connector 200 activates the switch 902. When activated, the switch 902 establishes a conductive path by shorting two wires, which shall be described in more detail with reference to FIG. 14.

Figure 15:
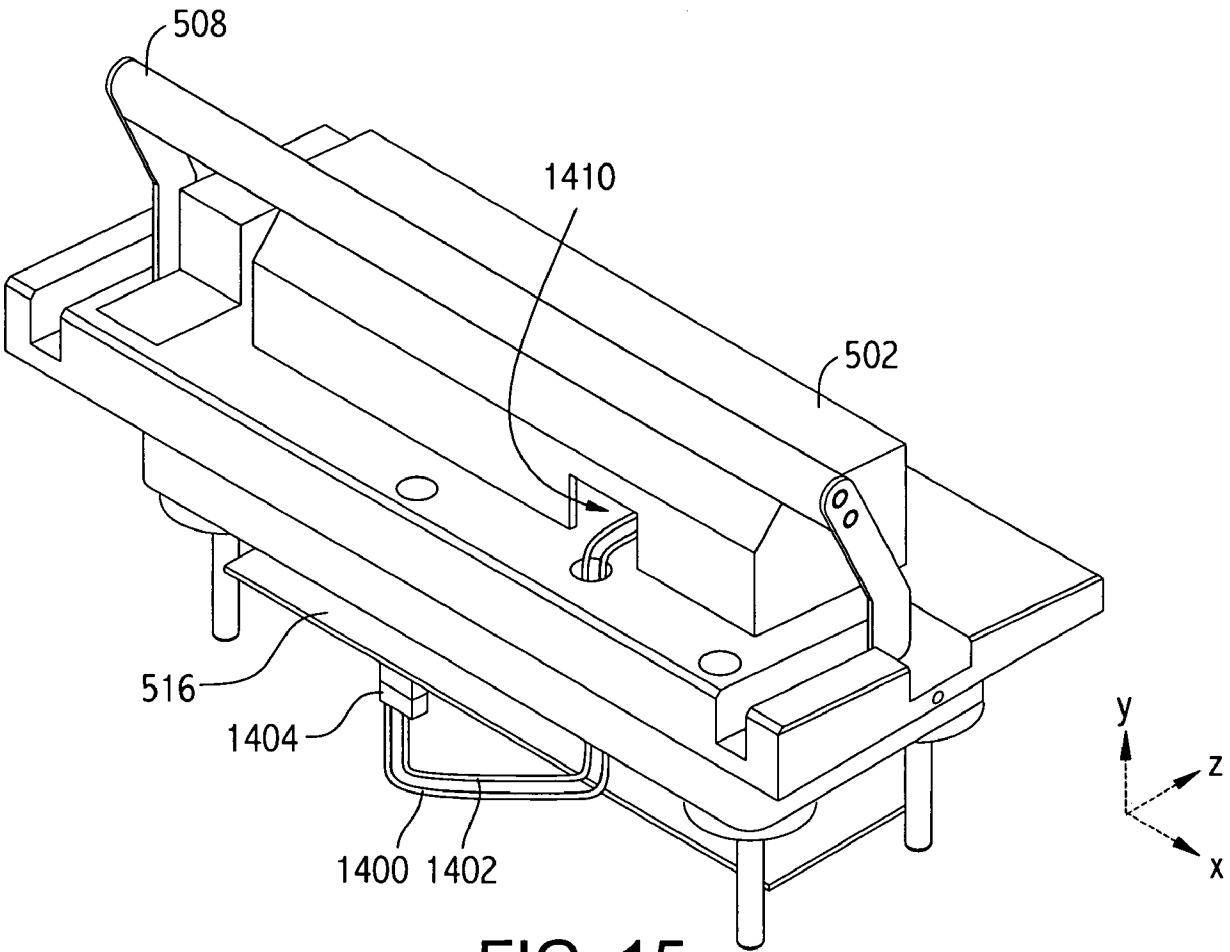
FIG. 15 is a back perspective view of the device interface apparatus depicted in FIG. 8.

With reference to FIG. 15, the switch 902 (FIG. 13) is connected to the wires 1400 and 1402 such that when the connector 200 (FIG. 10) pushes on the switch 902 a conductive path is established through the wires 1400 and 1402.

The wires 1400 and 1402 are connected to a jump connector 1404. Such connection to the connector 1404 can be used in a variety of ways depending upon the application of the apparatus 500. For example, a computer and/or other electronics (not shown) may be interfaced with the connector 1404 and/or the wires 1400 and 1402. Thus, when there is a short detected across the wires 1402 and 1400, the computer and/or the electronics can be configured to turn on power going to the probes 512 or transmit signals through the probes 512. In this regard, power is originating through the port 514 via the connector (not shown) that is connected to the port 514. When the switch 902 is deactivated, the test equipment is disables from communicating with probes 512 through the port 514. Note that the switch generally detects whether there is a connector 200 inserted in slot 906.

To the contrary, when the switch 902 is not depressed by a connector 200 in the slot 906 thereby breaking a conductive path, i.e., when the connector 200 is not present in the slot 906, then the computer and/or electronics can turn power off that is being provided to the probes 512. Note that the power may be provided by a cable terminator (not shown), such as, for example, a "champ" connector, inserted into the port 514. Regardless of the source of the power, the switch 902 provides a detectable parameter for indicating whether there is a connector 200 in the slot 906. Depending upon the application of the apparatus 500, detection of a connector 200 in the slot 906 might be used to cause power to be shut off from the probes 512.

Figure 16:
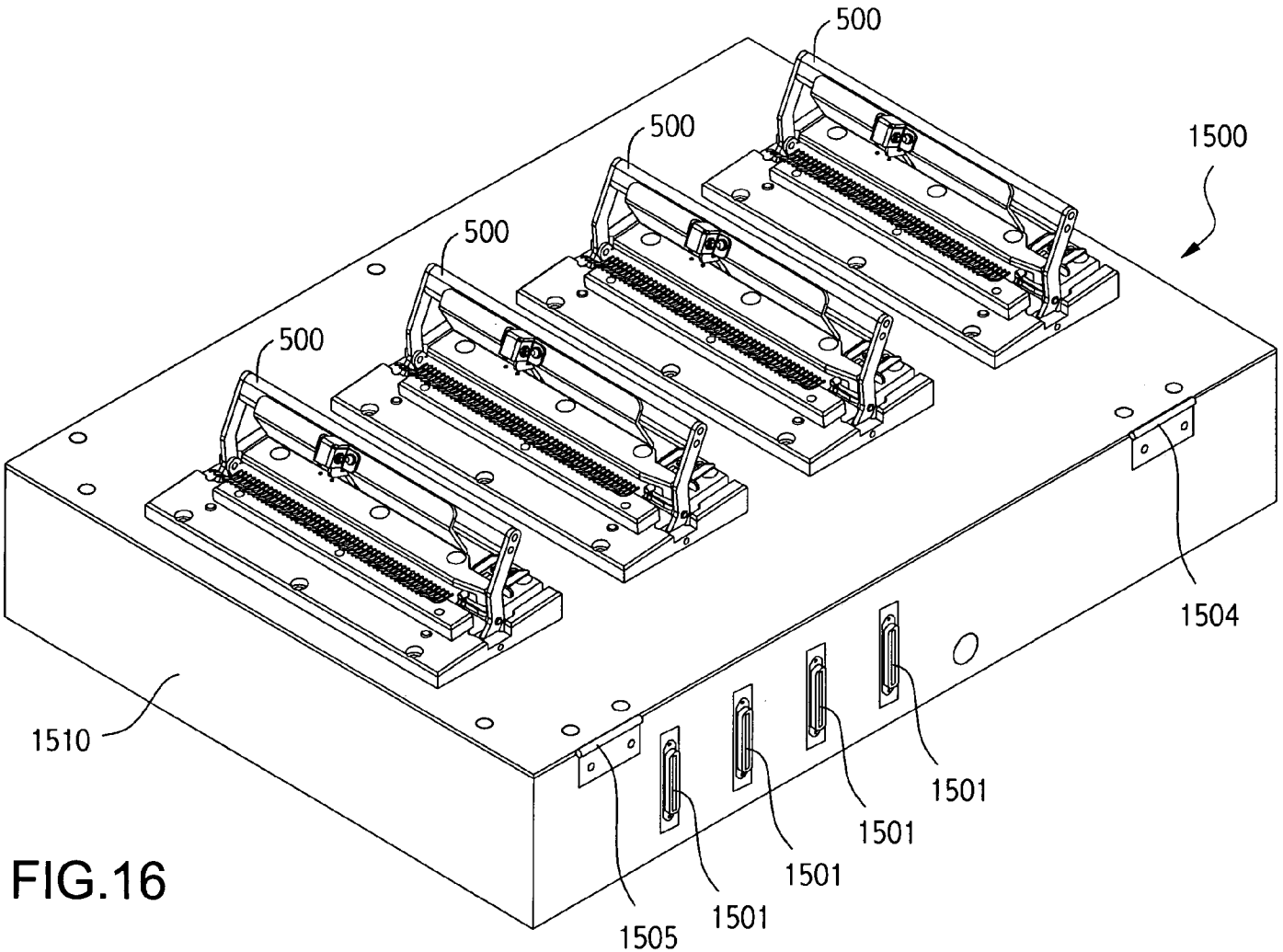
FIG. 16 is a perspective view of a chassis in accordance with an exemplary embodiment of the present disclosure for housing a plurality of device interface assemblies depicted in FIG. 8.

FIG. 16 depicts an interface chassis 1500 in accordance with an embodiment of the present disclosure. In such an embodiment, a housing 1510 comprises a plurality of interface apparatuses 500 of the present disclosure. The chassis 1510 comprises a plurality of ports 1501 for receiving cable terminator (not shown) that are connected to the respective ports 514 of the apparatuses 500. Furthermore, the chassis provides hinges 1504 and 1505 that enable a user (not shown) to lift the top of the housing 1510 for easy access to the apparatuses 500.

Now, therefore, the following is claimed:

1. An interface apparatus, the apparatus comprising:

a connector-receiving unit having at least one opening, the connector-receiving unit for receiving a connector communicatively coupled via a conductor to a first device, the connector having a first receiving opening corresponding to the conductor and a second receiving opening that aligns with the at least one opening in the connector-receiving unit when the connector is inserted into the connector-receiving unit;

a port for receiving a cable terminator, the cable terminator electrically connected to a second device configured to communicate with the first device; and a movable component connected to the port, the movable component comprising a probe, the movable component further comprising an actuator that, when actuated, moves the probe through the at least one opening and into the second receiving opening of the connector thereby establishing a conductive path between the first device and the second device.

2. The apparatus of claim 1, wherein the connector-receiving unit further comprises a stop for retaining the connector in the receiving unit.

3. The apparatus of claim 1, wherein the connector-receiving unit further comprises an assembly for prohibiting movement of the connector when the probe is engaged by the second receiving opening.

4. The apparatus of claim 1, wherein the connector-receiving unit prohibits the probe from being inserted through the at least one opening into the second receiving opening if the connector is not completely seated within the receiving unit.

5. The apparatus of claim 1, wherein the connector-receiving unit is connected to the movable component at an angle such that insertion of the probe into the receiving opening is at the angle.

6. The apparatus of claim 1, where the connector is a 710 modular connector having a plurality of receiving openings corresponding to a plurality of conductors.

7. The apparatus of claim 1, wherein the connector is a 5-pair connector, a 10-pair connector, or a 25-pair connector.

8. The apparatus of claim 6, wherein the second device is a test unit for testing a DSLAM and the test unit comprises a cable terminated via a port connector.

9. The apparatus of claim 8, further comprising:

a printed circuit board (PCB) electrically interfaced to the port, the PCB comprising a plurality of conductive probes; and a probe elevator rigidly affixed to the PCB and to the plurality of conductive probes.

10. The apparatus of claim 9, wherein the probe elevator is movably attached to the receiving-unit via a handle such that when the handle is actuated, the probe elevator inserts the plurality of conductive probes into the plurality of receiving openings of the connector inserted in the receiving unit.

11. An interface apparatus, the apparatus comprising:

a connector-receiving unit for receiving a connector communicatively coupled via a conductor to a first device, the connector having a receiving opening corresponding to the conductor;

a port for receiving a cable terminator, the cable terminator electrically connected to a second device configured to communicate with the first device; and a movable component connected to the port, the movable component comprising a probe, the movable component further comprising an actuator that, when actuated, moves the probe into the receiving opening of the connector establishing a conductive path between the first device and the second device, wherein the connector-receiving unit further comprises a switch configured to detect when a connector is present in the receiving unit.

12. An interface apparatus, the apparatus comprising:

a connector-receiving unit for receiving a connector communicatively coupled via a conductor to a first device, the connector having a receiving opening corresponding to the conductor;

a port for receiving a cable terminator, the cable terminator electrically connected to a second device configured to communicate with the first device; and a movable component connected to the port, the movable component comprising a probe, the movable component further comprising an actuator that, when actuated, moves the probe into the receiving opening of the connector establishing a conductive path between the first device and the second device, wherein the connector-receiving unit reforms the connector if the connector has been deformed.

13. An interface apparatus, the apparatus comprising:

a connector-receiving unit for receiving a connector communicatively coupled via a conductor to a first device, the connector having a receiving opening corresponding to the conductor;

a port for receiving a cable terminator, the cable terminator electrically connected to a second device configured to communicate with the first device;

a movable component connected to the port, the movable component comprising a probe, the movable component further comprising an actuator that, when actuated, moves the probe into the receiving opening of the connector establishing a conductive path between the first device and the second device; and logic configured to terminate power to the probe when the logic determines that there is not a connector in the receiving unit.

14. A method for interfacing, the method comprising the steps of:

receiving a connector at a connector-receiving unit having a slot and at least one receiving opening, the connector electrically connected via a conductor to a network component, the connector having a first receiving opening corresponding to the conductor and a second receiving opening;

sliding the connector into the slot of the connector-receiving unit until the at least one receiving opening and the second receiving opening align;

receiving a cable terminator via a port of the connector-receiving unit, the cable terminator electrically connected to a second device configured to communicate with the network component, the port conductively coupled to a conductive probe movably positioned with respect to the receiving opening; and actuating an actuation component that moves the conductive probe through the at least one receiving opening of the connector-receiving unit and into the second receiving opening of the connector such that the probe engages a conductive contact thereby establishing a conductive path between the network component and the second device.

15. The method of claim 14, further comprising the step of retaining the connector in the connector-receiving unit such that movement of the connector is prohibited.

16. The method of claim 15, further comprising the step of retaining the connector when the conductive probe is engaged with the second receiving opening.

17. The method of claim 16, wherein the connector is a 710 modular connector having a plurality of receiving openings corresponding to the plurality of conductors.

18. An apparatus for interfacing with a network device, comprising:

a receiving unit having a slot, the slot configured to receive a connector;

a plunger assembly connected to the receiving unit comprising a stop that recedes within the slot of the receiving unit when the plunger assembly is actuated and protrudes into the slot of the receiving unit when the plunger assembly is released; and a component configured to interface the connector via a plurality of contact probes with a port for communication to a test device, the component further configured to prevent removal of the connector from the slot when the connector is interfaced to the test device via the plurality of contact probes by the stop protruding within the slot.

19. The apparatus of claim 18, wherein the receiving unit prohibits the plurality of probes from being interfaced with the connector if the connector is not completely seated within the receiving unit.

20. An interface method, comprising the steps of:

receiving a connector communicatively coupled via a conductor to a first device, the connector having a receiving opening corresponding to the conductor;

receiving a cable terminator via a port, the cable terminator electrically connected to a second device configured to communicate with the first device;

actuating a movable component connected to the port that moves a probe into the receiving opening of the connector establishing a conductive path between the first device and the second device; and automatically detecting when a connector is present in the receiving unit.

21. The method of claim 19, further comprising the step of terminating power to the probe based on the detection step.

* * * * *